United States Patent [19]

Yoshida et al.

[11] 4,303,106

[45] Dec. 1, 1981

[54] METHOD AND APPARATUS FOR CARRYING OUT THE FILLING OPERATION IN A JET LOOM

[75] Inventors: Kazunori Yoshida, Nagoya; Fuzio Suzuki, Toyota; Hiroshi Arakawa, Kariya; Takeshi Kobayashi, Aichi, all of Japan

[73] Assignees: Kabushiki Kaisha Toyoda Jidoshokki Seisakusho; Kabushiki Kaisha Toyota Chou Kenkyusho, both of Aichi, Japan

[21] Appl. No.: 74,813

[22] Filed: Sep. 12, 1979

[30] Foreign Application Priority Data

Sep. 18, 1978 [JP] Japan ..... 53/114244

[51] Int. Cl.[3] ..... D03D 47/30

[52] U.S. Cl. ..... 139/435; 139/1 C

[58] Field of Search ..... 139/144, 435, 1 C; 226/95, 97; 239/407, 410

[56] References Cited

U.S. PATENT DOCUMENTS

| | | | |
|---|---|---|---|
| 3,672,406 | 6/1972 | Vermeulen | 139/435 |
| 3,828,829 | 8/1974 | Gotoh et al. | 139/435 |
| 4,187,888 | 2/1980 | Mullekom | 139/435 |

*Primary Examiner*—Henry Jaudon

*Attorney, Agent, or Firm*—Burgess, Ryan & Wayne

[57] ABSTRACT

Method and apparatus for carrying out the filling operation in a jet loom, wherein a main nozzle is provided for flying a weft through a guide passage formed on a sley at the time of each filling operation. When the supply of a compressed fluid into the main nozzle is stopped immediately after the completion of a filling operation, the compressed fluid present between a transfer valve connected to a fluid supply source and the main nozzle is positively discharged into the atmosphere simultaneously with the stopping of the supply of the compressed fluid, so as to promptly reduce the fluid pressure in the main nozzle, by utilizing the transfer valve designed for the present invention.

12 Claims, 15 Drawing Figures

TO CONTROL DEVICE 11

METHOD AND APPARATUS FOR CARRYING OUT THE FILLING OPERATION IN A JET LOOM

BACKGROUND OF THE INVENTION

1. Field of the Invention

The present invention relates to a method and apparatus for inserting a weft into a shed of a jet loom.

2. Description of the Prior Arts

The weft insertion of a weft into a shed is hereinafter referred to as "filling".

In the known jet loom such as the loom disclosed in U.S. Pat. No. 3,672,406, a compressed fluid is jetted from a main fluid jetting nozzle disposed on a side portion of the machine frame, and a weft is caused to fly through a guide passage formed on a sley at the time of each filling operation. The timing of the jetting of the fluid is adjusted by a transfer valve connected to a compressed fluid supply source disposed independently from the main nozzle for jetting the fluid. When a flow passage is opened by the transfer valve at the time of filling, the pressure in the main nozzle is elevated to a predetermined level after a cetain time lag and the fluid is jetted for a time necessary for filling. After passage of the time necessary for filling, the flow passage is shut by the transfer valve and, therefore, supply of the fluid from the compressed fluid supply source is stopped. However, since the main nozzle is provided with a narrowed passage, the reduction of the fluid pressure of the compressed fluid present between the transfer valve and the main nozzle is delayed and a relatively long time passes before the jetting of the fluid from the main nozzle is actually stopped. Therefore, the fluid is jetted from the main nozzle for a certain time even after completion of the filling operation, and hence, a high pressure is imposed on a weft stopped by an action of a control device and back twists are imparted to the weft. As a result, a defect of weft breakage is caused.

SUMMARY OF THE INVENTION

It is the primary object of the present invention to provide a method and an apparatus for carrying out the filling operation in a jet loom by which the above-mentioned drawbacks of the conventional jet loom are improved.

To attain the above-mentioned purpose, in the filling method according to the present invention, simultaneously with stopping of the supply of a compressed fluid by a transfer valve, the compressed fluid present between the transfer valve and main nozzle is positively discharged e.g. into the open air to promptly reduce the fluid pressure in the main nozzle, whereby delay of the stopping of the fluid jetting from the main nozzle is prevented and the undesirable influences of the fluid from the main nozzle on wefts kept stationary after the filling operation are eliminated. Therefore, in the apparatus according to the present invention, to carry out the above-mentioned method, a positive means for discharging the compressed fluid between the transfer valve and the main nozzle at a predetermined valve is utilized to attain the purpose of the present invention.

DETAILED DESCRIPTION OF THE PREFERRED EMBODIMENTS

The present invention will now be described in detail with reference to embodiments illustrated in the accompanying drawings.

Figure 1:
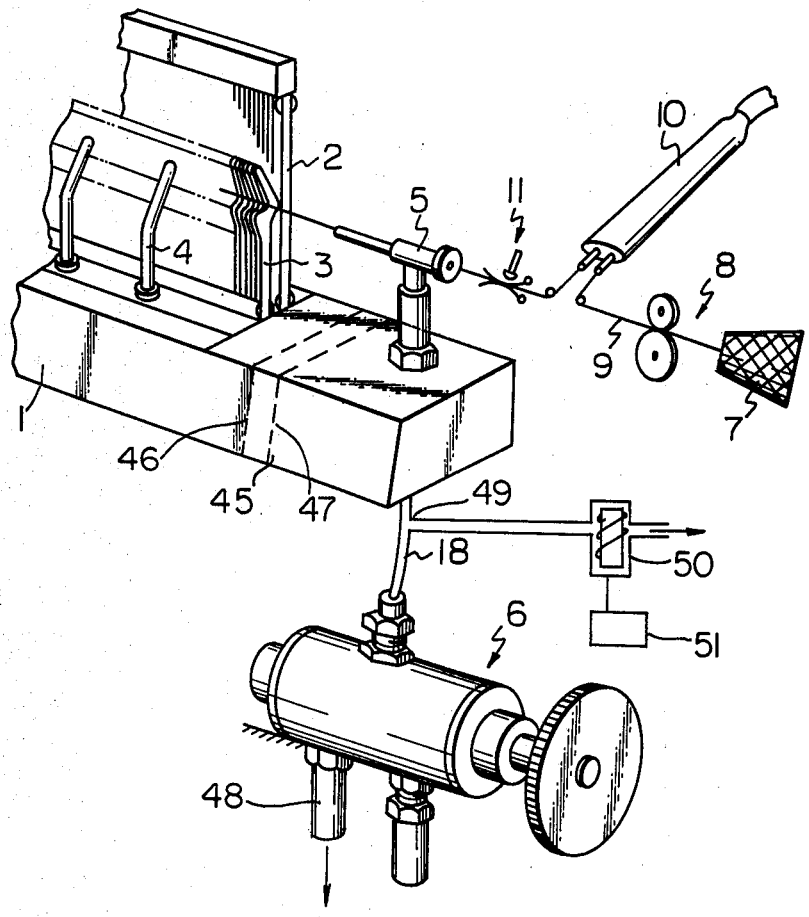
FIG. 1 is a schematic perspective view of the filling apparatus according to the present invention.

Referring to FIG. 1 schematically illustrating the outline of the filling apparatus, a reed 2, guide members 3 defining a fluid and weft guide passage and auxiliary nozzles 4 having an auxiliary fluid jetting opening directed to the guide passage of the guide member are aligned respectively in parallel condition to each other on a sley 1, a main nozzle 5 directed to the guide passage is rigid disposed on the end portion of the sley 1, and this main nozzle 5 is connected to a compressed fluid source (not shown) through a transfer valve 6. A weft 9 taken out from a fixed weft supply member 7 by a length measuring device 8 is temporarily reserved in a weft reserving device 10 and, then, inserted into the main nozzle 5 via a control device 11. Accordingly, when the main nozzle 5 is communicated with the compressed fluid source through the transfer valve 6, the compressed fluid is jetted from the main nozzle 5, and simultaneously, the weft 9 is carried by the fluid to effect filling of the weft 9. After completion of the filling operation, the fluid flow passage is closed by the transfer valve 6, and the running of weft 9 is controlled by the control device 11 and a beating operation is carried out.

The filling apparatus having the above-mentioned structure is one embodiment of the filling apparatus to which the present invention is applied, and various modifications may be made to this embodiment. For example, the main nozzle 5 may be fixed to the machine frame by terminating the sley 1 at the dashed line 46, the support 45 on which the nozzle 5 is mounted being secured to the machine frame (not shown) and having a stationary surface 47 adjacent the moving sley surface 46, or the guide passage defined by the guide member 3 may be constructed by modifying the reed. Although the guide passage in the embodiment illustrated in FIG. 1 is semi-opened, it is possible to form a cylindrical passage by using a substantially circular guide member.

Figure 2:
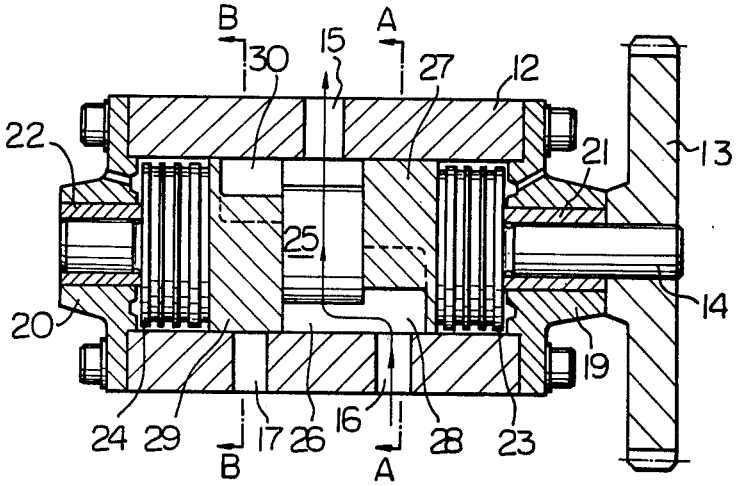
FIG. 2 is a sectional front view of the transfer valve utilized in the apparatus illustrated in FIG. 1, in the state where a fluid is being supplied.
Figure 3:
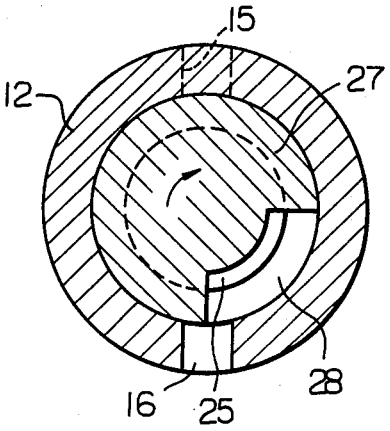
FIG. 3 is a sectional view of the transfer valve taken along the line A—A in FIG. 2.
Figure 4:
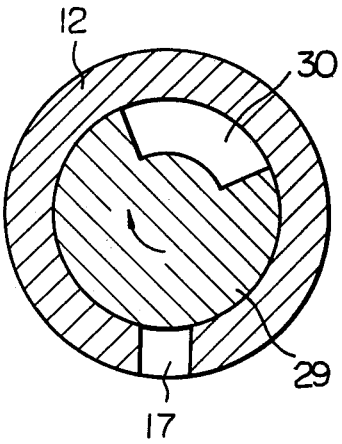
FIG. 4 is a sectional view of the transfer valve taken along the line B—B in FIG. 2.

FIGS. 2 to 7 illustrate the structure of one embodiment of the transfer valve according to the present invention. A housing 12 fixed to the machine frame has a cylindrical space in the interior thereof, and a rotary member 14 is fitted in this cylindrical space so that it can be rotated through a driven gear 13. In the upper portion, in FIG. 2, of the center of the housing 12, a flow-out opening 15 is formed, and a flow-in opening 16 and a discharge opening 17 are formed in the lower portion of the center of the housing 12. The flow-out opening 15 is connected to the main nozzle 5 through a conduit 18, and the flow-in opening 16 is connected to the compressed fluid supply source (not shown) and the discharge opening 17 is opened to the open air. Referring to FIG. 2, both ends of the rotary member 14 are supported by bearings 21 and 22 at bearings 19 and 20 rigidly mounted to the housing 12. Labyrinth mechanisms 23 and 24 are formed on both the sides of the rotary member 14 to seal the inner space of the housing 12. In this sealed space, the rotary member 14 has a small-diameter portion 25 substantially at the center thereof, and a space 26 always opened, which confronts the flow-out opening 15, is formed around this small-diameter portion 25. A large-diameter portion 27 located on the right side (in FIG. 2) of the small-diameter portion is rotated in the state where the large-diameter portion 27 is contacted closely with the inner wall portion of the housing 12. In a part of the large-diameter portion 27, a fan-shaped space 28 corresponding to the time necessary for the filling operation is formed, as seen in FIG. 3, which illustrates the section taken along the line A—A in FIG. 2. This space 28 is communicated with the above-mentioned space 26 confronting the flow-out opening 15, and this space 28 is arranged in such a way that, when the rotary member 14 is rotated in a direction indicated by an arrow in FIG. 3, the space 28 is allowed to confront the flow-in opening 16 and is communicated therewith synchronously with the timing of the filling operation. Furthermore, a large-diameter portion 29 on the left side (in FIG. 2) of the small-diameter portion 25 is rotated in the state where it is contacted closely with the inner wall portion of the housing 12 like the above-mentioned large-diameter portion 27. As is seen from FIG. 4, showing the section taken along the line B—B in FIG. 2, a fan-shaped space 30 is formed in a part of the large-diameter portion 29. This space 30 is communicated with the space 26 confronting the flow-out opening 15, and is arranged so that on completion of the filling operation by rotation of the rotary member 14, the space 30 is allowed to confront the discharge opening 17 and be communicated therewith. The time for communication of the space 30 with the discharge opening 17 is determined by the volume of the compressed fluid present in the passage between the transfer valve 6 and the main nozzle 5. As seen from FIGS. 3, 4, 6 and 7, the position of this space 30 is arranged so that while the space 28 is communicated with the flow-in opening 16, the space 30 is not communicated with the discharge opening 17, and while the space 30 is communicated with the discharge opening 17, the space 28 is not communicated with the flow-in opening 16.

The operation of the transfer valve of the present invention having the above-mentioned structure will now be described.

Figure 5:
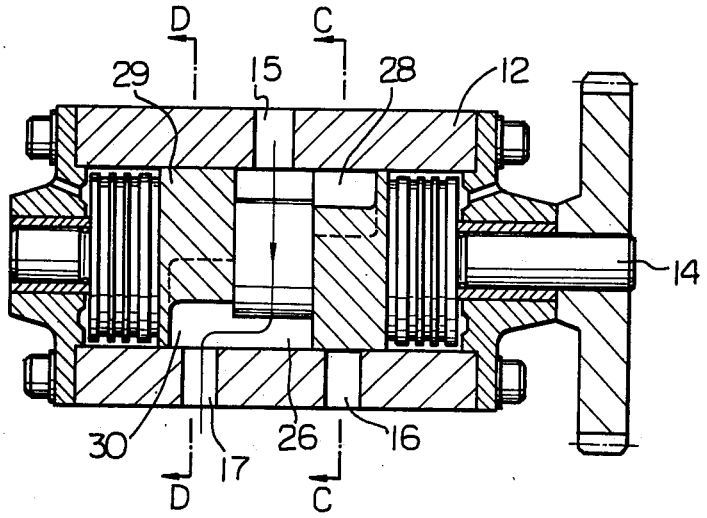
FIG. 5 is a sectional front view of the transfer valve illustrated in FIG. 1, in the state where supply of a fluid is stopped.
Figure 6:
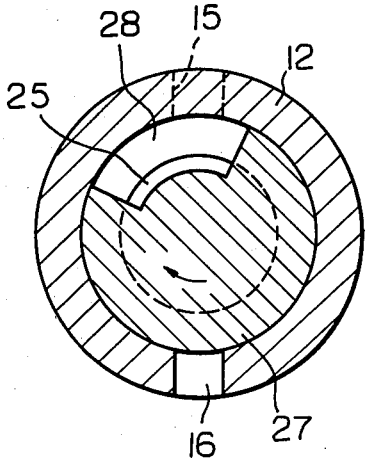
FIG. 6 is a sectional view of the transfer valve taken along the line C—C in FIG. 5.
Figure 7:
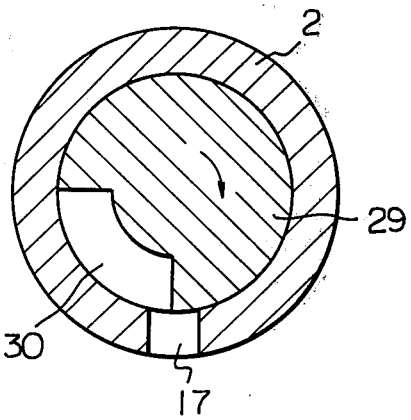
FIG. 7 is a sectional view of the transfer valve taken along the line D—D in FIG. 5.
Figure 8:
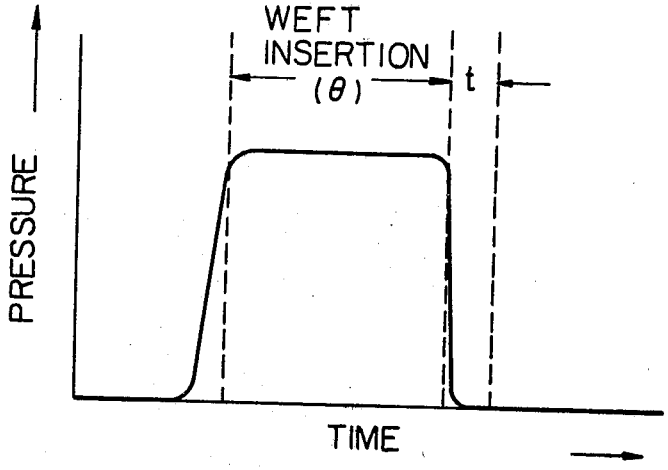
FIG. 8 is a graph showing the change of the fluid pressure in the main nozzle according to the present invention.

The rotary member 14 is rotated synchronously with the operation of the loom, and at the time for inserting a weft into a shed, the space 28 on the side of the large-diameter portion 27 becomes communicated with the flow-in opening 16 to form a flow passage. Accordingly, the fluid supplied from the compressed fluid supply source is allowed to arrive at the main nozzle 5 through the flow-in opening 16, spaces 28 and 26, flow-out opening 15 and pipe 18, and is jetted from the main nozzle 5. Jetting of the fluid is carried out while the space 28 is communicated with the flow-in opening 16, and this period corresponds to the weft insertion time shown in FIG. 8. After the predetermined weft insertion time has passed, communication of the space 28 with the flow-in opening 16 is stopped and, accordingly, supply of the compressed fluid is stopped. At this point, the space 30 on the side of the large-diameter portion 29 becomes communicated with the discharge opening 17 as illustrated in FIG. 5. Accordingly, the fluid present in the main nozzle 5, pipe 18, flow-out opening 15 and space 26 is immediately released into the open air through the discharge opening 17. As a result, the fluid pressure in the main nozzle 5 is promptly reduced, and jetting of the fluid from the main nozzle 5 is stopped substantially simultaneously with stopping of supply of the compressed fluid, although there is a very small time lag t (FIG. 8). Therefore, the weft 9 stopped by the control device 11 is not influenced by the compressed fluid.

Figure 9:
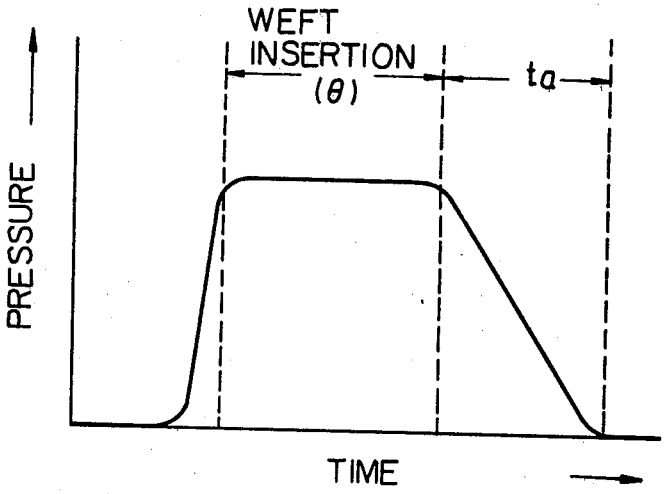
Fig. 9 PRIOR ART
FIG. 9 is a graph showing the change of the fluid pressure in the conventional main nozzle.

On the other hand, in the conventional transfer valve, as shown in FIG. 9, it is necessary to spend a fairly long time ta for stopping the fluid jetting from the main nozzle 5 after the completion of the weft insertion. Therefore, the fluid is ejected from the main nozzle 5 during the period ta, and the problem which was described in the description above, entitled "Background of the invention", can not be avoided.

In the above-mentioned embodiment, the compressed fluid discharged from the discharge opening 17 may be discharged into the atmosphere. However, if the compressed fluid discharged from the opening 17 is led to the control device 11 via conduit 48 or weft tensers (not shown), or a weft cutter (not shown), it is possible to remove dust or flies deposited on those elements by the above-mentioned compressed fluid.

Next, another embodiment of the transfer valve utilized for the apparatus according to the present invention will be explained in detailed with reference to FIGS. 10, 11, 12, 13, 14 and 15. A housing 31 rigidly mounted on the machine frame is provided with a cylindrical space 38 defined by a pair of disc 37*a*, 37*b* which are sealed by respective sealing members 36*a*, 36*b*. A rotatable body 32, which is driven by a driving gear mechanism (not shown), is rigidly engaged in the central apertures of the sealing members 36*a*, 36*b* and the discs 37*a*, 37*b*.

Figure 10:
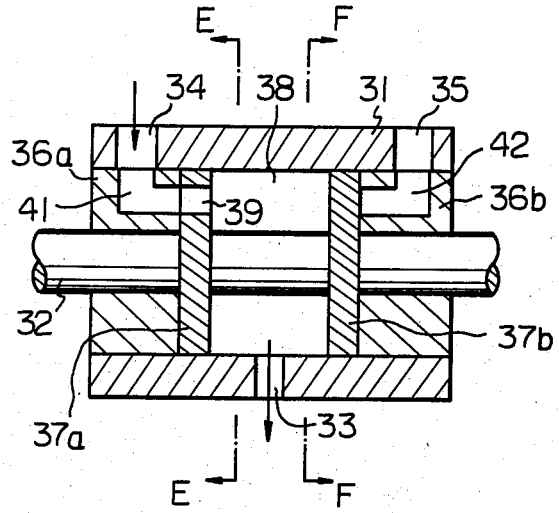
FIG. 10 is a schematic sectional front view of another embodiment of the transfer valve utilized for the apparatus according to the present invention, at the time of filling.
Figure 11:
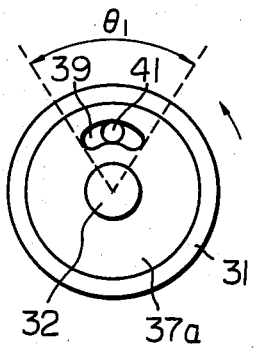
FIGS. 11 and 12 are sectional views of the change-over valve taken along the lines E—E, and F—F, respectively, in FIG. 10 .
Figure 12:
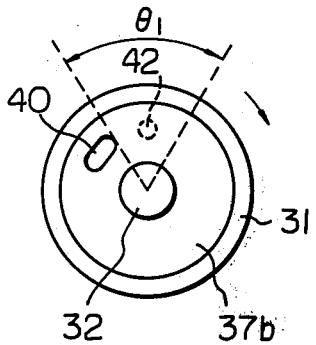
Figure 13:
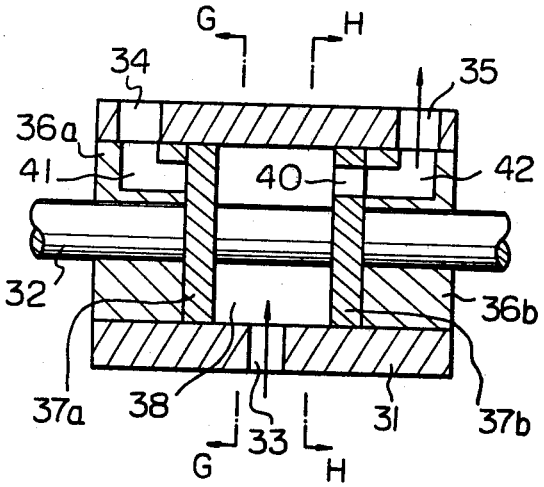
FIG. 13 is a schematic sectional front view of the transfer valve illustrated in FIG. 10, at the time of stopping the supply of the compressed fluid and discharging the compressed fluid.
Figure 14:
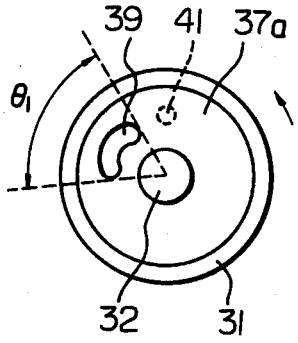
FIGS. 14 and 15 are sectional views of the change-over valve taken along the lines G—G, and H—H, respectively in FIG. 13.

In the housing 31, a flow-out opening 33 is formed at a central lower portion thereof, while a flow-in opening 34 and a discharge opening 35 are formed at an upper portion thereof, as illustrated in FIG. 10. The flow-out opening 33 is connected to the main nozzle 5 via the pipe 18, the flow-in opening 34 is connected to the compressed air supply source (not shown), while the discharge opening 35 is opened e.g. to atmosphere. The disc 37*a* is provided with an inlet aperture 39, while the disc 37*b* is provided with an outlet aperture 40. The sealing members 36*a*, 36*b* are provided with spaces 41, 42, respectively, which are continuously communicated with the flow-in opening 34 and the discharge opening 35, respectively. The above-mentioned discs 37*a*, 37*b* are capable of rotating in the housing 31 in such a contacting condition with the inside wall of the housing 31. As will be easily understood from FIG. 11, the inlet aperture 39 formed in the disc 37*a* radially extends for an angle $\theta_1$ with respect to the rotational axis of the disc 37*a*. This angle $\theta_1$ corresponds to a time necessary completely for carrying out the filling operation. The position of the inlet aperture 39 is designed so as to satisfy the condition that the timing for communication of the aperture 39 with the space 41 is suitable for carrying out the filling operation when the disc 37 is rotated toward a direction represented by an arrow in FIG. 11. On the other hand, the position of the outlet aperture 40 is designed so as to satisfy the condition that the aperture 40 communicates with the space 42 at the time of completion of the weft insertion in a shed. The time period for maintaining the communication between the outlet aperture 40 and the space 42 is set in accordance with the capacity of the compressed fluid between the main nozzle 5 and the transfer valve 6. The position of the aperture 40 is designed so as to satisfy the condition that the aperture 40 can not communicate with the space 42 during a period when the inlet aperture 39 communicates with the space 41, while the inlet aperture 39 can not communicate with the space 41, during a period when the outlet aperture 40 communicates the space 42, as illustrated in FIGS. 11, 12, 14 and 15.

Figure 15:
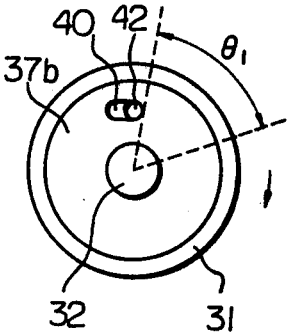

The above-mentioned transfer valve is operated as hereinafter explained in detail. That is, the rotational body 32 is syncronously driven with the driving of the jet loom, and when the time for starting the filling operation arrives, the inlet aperture 39 communicates with the space 41 so that a fluid passage is created. Therefore, the compressed air supplied from the compressed air supply source can be led to the main nozzle 5 via the flow in opening 34, the space 41, the inlet aperture 39, the space 38, the flow-out opening 33 and the pipe 18, and consequently, the compressed air is jetted from the main nozzle 5. The above-mentioned jetting action is carried out during a period defined by an angle $\theta_1$, wherein the inlet aperture 39 communicates with the space 41, and the weft insertion is carried out in this period ($\theta_1$) as shown in FIG. 8. When the period ($\theta_1$) for weft insertion has elapsed, the communication between the inlet aperture 39 and the space 41 is simultaneously stopped with the above-mentioned elapse of the period ($\theta_1$). Therefore, the supply of the compressed air is stopped and, at this time, the outlet aperture 40 is communicated with the space 42 as illustrated in FIG. 15. Consequently, the compressed fluid remaining in the main nozzle 5, the pipe 18, the flow-out opening 33 and the space 38 is instantly discharged into the atmosphere via the discharge opening 35, so that the fluid pressure in the main nozzle 5 is rapidly reduced. As a result, the jetting of fluid from the main nozzle 5 can be stopped at almost the same time as the stopping of the fluid supply from the supply source, even if there is a certain time lag (t), fluid action imparted to the weft 9 stopped by the control device 11 can be eliminated. As mentioned in the case of the first embodiment of the transfer valve illustrated FIG. 2, it is preferable to use the compressed fluid discharge from the transfer valve in the second embodiment for removing dust and flies deposited on the machine parts, instead of discharging the remaining compressed fluid into atmosphere.

In the above-mentioned two embodiments, the opening for discharging the excess compressed air from the transfer valve is formed in the transfer valve itself. However, according to the basic technical idea of the present invention, the invention is not limited to the forming of the discharge opening in the transfer valve itself, and it is also useful to form the discharging opening at any position in a region communicating the main nozzle and the transfer valve e.g. via the T connection 49 in the conduit 18. Regarding the method for opening or closing the above-mentioned discharging opening, an electrical or a mechanical method can be applied. For example, in the case of applying a mechanical method, the discharging opening is opened after completion of the weft insertion by means of a cam mechanism driven in cooperation with the motion of the jet loom, while in the case of applying an electrical method, a solenoid 50 operated by electrical control means 51 can be used for actuating the discharge opening.

As will be apparent from the above-mentioned illustration, according to the present invention, the compressed fluid present in the passage between the transfer valve and the main nozzle is positively released e.g. into the atmosphere simultaneously with stopping of the supply of the fluid from the compressed fluid supply source, so as to promptly reduce the pressure of the fluid in the main nozzle. By virtue of this characteristic feature, in the present invention, jetting of the fluid from the main nozzle is stopped substantially simultaneously with stopping of the supply of the compressed fluid, and the weft controlled by the control device and present in the main nozzle after the filling operation does not undergo the action of the compressed fluid. Therefore, occurrence of such undesirable phenomena as untwisting of the weft and weft breakage can be prevented. It is also a further advantage of the present invention that, if the compressed air discharged from the discharge opening is led to the control device, weft tensers or a weft cutter by means of a conduit or conduits, dust or flies deposited on those machine elements can be effectively removed.

What is claimed is:

1. In a jet loom provided with a plurality of guide members disposed in an alignment on a sley to form a fluid and weft guide passage, a fluid jetting main nozzle directed to said guide passage and a transfer valve which is connected to the main nozzle so that at the filling time a flow of compressed fluid is started to the main nozzle and a volume of a compressed fluid is accumulated between the main nozzle and the transfer valve, and a fluid is jetted from the main nozzle, and after the filling operation, jetting of the fluid is stopped, the improved filling method comprising jetting the fluid from the main nozzle at the filling time, stopping the flow of compressed fluid to the main nozzle after the elapse of the time necessary for the filling operation, and simultaneously discharging the compressed fluid accumulated between the transfer valve and the main nozzle, whereby the fluid pressure in the main nozzle is promptly reduced.

2. A filling method according to claim 1, further comprising utilizing the compressed fluid discharged from between the transfer valve and the main nozzle for removing dust and flies deposited on machine parts.

3. In a jet loom having a plurality of guide members disposed in an alignment on a sley to form a fluid and weft guide passage, a fluid jetting main nozzle directed to said guide passage and a transfer valve which is connected to said main nozzle so that, at the filling time, a flow of compressed fluid is started to the main nozzle and a volume of compressed fluid is accumulated between the main nozzle and the transfer valve and a fluid is jetted from the main nozzle, and after the filling operation, jetting of the fluid is stopped, an improved filling apparatus having means for positively discharging compressed fluid accumulated between said transfer valve and said main nozzle at a predetermined time.

4. A filling apparatus according to claim 3, wherein said means for positively discharging accumulated compressed fluid comprises means for stopping the flow of compressed fluid to the main nozzle and means for simultaneously positively discharging the accumulated compressed fluid between the main nozzle and the transfer valve.

5. A filling apparatus according to claim 4, wherein said means for stopping the flow of the compressed fluid to the main nozzle and the means for discharging the accumulated compressed fluid are contained in the transfer valve.

6. A filling apparatus according to claim 5, wherein said transfer valve comprises a housing provided with a cylindrical space and a rotatable member engaged with said cylindrical space, said housing being provided with a flow-out opening connected to said main nozzle, a flow-in opening connected to a supply source of said compressed fluid, and a discharge opening, said rotatable member having a first space communicating with said discharge opening and a second space which is capable of communicating with said flow-in opening during a first predetermined time said second space always being in communication with said first space, and a third space which is capable of communicating with said discharging opening during a second predetermined time, said third space always being in communication with said first space.

7. A filling apparatus according to claim 5, wherein said transfer valve comprises a housing provided with a cylindrical space formed therein, a pair of sealing members closing the two side openings of said open cylindrical space, a member rotatably engaged in a central aperture of each of said sealing members, a pair of discs rigidly mounted on said rotatable member at respective positions which enable said discs to slidably contact the inside wall of a corresponding sealing member and also to slidably contact the inside cylindrical wall of said housing, said housing being provided with a flow-out connected to said main nozzle at a position between said discs, and a flow-in opening connected to a supply source of compressed fluid and a discharge opening for discharging the compressed fluid accumulated between the transfer valve and the main nozzle, a first one of said sealing members having a second space which is always in communication with said discharge opening, a first one of said discs contacting said first sealing member provided with an aperture capable of communicating with said first space during a first predetermined period, a second one of said discs contacting said second sealing member provided with an aperture capable of communicating with said second space during a second predetermined period.

8. A filling apparatus according to claim 4, wherein said discharge means is actuated by mechanical means.

9. A filling apparatus according to claim 4, wherein said discharging means is actuated by electrical means.

10. A filling apparatus according to claim 4, further comprising a conduit means connecting a discharge outlet of said discharging means with a position on a machine element of said jet loom, whereby, when said discharge means is actuated to discharge compressed fluid, said compressed fluid is discharged at a place defined by said position on said machine element.

11. A filling apparatus according to claim 3, wherein said main nozzle is mounted on a sley of said jet loom.

12. A filling apparatus according to claim 3, wherein said main nozzle is mounted on a machine frame of said jet loom.

* * * * *